US012679431B2

(12) United States Patent
Liktor et al.

(10) Patent No.: US 12,679,431 B2
(45) Date of Patent: Jul. 14, 2026

(54) DIGITAL FREIGHT CAR—AUTOMATIC WAGON LIST

(71) Applicant: KNORR-BREMSE SYSTEME FÜR SCHIENENFAHRZEUGE GMBH, Munich (DE)

(72) Inventors: Balazs Liktor, Budapest (HU); Laszlo Kovacs, Verőce (HU)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 36 days.

(21) Appl. No.: 18/563,253

(22) PCT Filed: Jun. 8, 2022

(86) PCT No.: PCT/EP2022/065505
§ 371 (c)(1),
(2) Date: Nov. 21, 2023

(87) PCT Pub. No.: WO2022/263248
PCT Pub. Date: Dec. 22, 2022

(65) Prior Publication Data

US 2025/0074483 A1 Mar. 6, 2025

(30) Foreign Application Priority Data

Jun. 15, 2021 (EP) ..... 21179549

(51) Int. Cl.
*B61L 15/00* (2006.01)
*B61L 25/02* (2006.01)
*B61L 27/57* (2022.01)

(52) U.S. Cl.
CPC ..... *B61L 15/0027* (2013.01); *B61L 15/0062* (2024.01); *B61L 25/025* (2013.01); *B61L 27/57* (2022.01); *B61L 2205/04* (2013.01)

(58) Field of Classification Search
CPC ..... B61L 15/0027; B61L 15/0062; B61L 25/025; B61L 25/028; B61L 27/57;
(Continued)

(56) References Cited

U.S. PATENT DOCUMENTS 5,682,139 A * 10/1997 Pradeep ..... B61L 25/025 455/12.1
5,691,980 A * 11/1997 Welles, II ..... H04W 84/20 370/316
(Continued)

FOREIGN PATENT DOCUMENTS

CN 107223102 A 9/2017
CN 112368197 A 2/2021
(Continued)

OTHER PUBLICATIONS

International Search Report and Written Opinion corresponding to PCT/EP2022/065505 dated Sep. 6, 2022.
(Continued)

*Primary Examiner* — John M Zaleskas
(74) *Attorney, Agent, or Firm* — Barnes & Thornburg LLP

(57) ABSTRACT

A system and method for automatic generation of a list of units in a train comprising multiple units use a plurality of sensors, wherein each of the plurality of sensors is configured to be mounted to a respective unit of the train and each of the plurality of sensors is configured to detect a parameter of the respective unit of the train to which it is mounted that is suitable to provide an information about the position of the unit with respect to another unit in the train. Further, the system includes a control device configured to receive the detected parameters from the plurality of sensors and to process the detected parameters for generation of the list of units.

13 Claims, 1 Drawing Sheet

(58) Field of Classification Search
CPC .... B61L 27/50; B61L 2205/04; B60T 17/228; H04L 67/12; H04W 4/42; H04W 84/005; H04W 84/18
See application file for complete search history.

(56) References Cited

U.S. PATENT DOCUMENTS

2002/0049520 A1* 4/2002 Mays ..... B61L 27/40 701/19
2002/0139181 A1* 10/2002 Marra ..... B60T 17/228 73/121
2005/0259598 A1* 11/2005 Griffin ..... B61L 15/00 370/255
2007/0208841 A1* 9/2007 Barone ..... B61L 15/0027 709/223
2007/0233335 A1* 10/2007 Kumar ..... G05B 13/021 701/22
2007/0241610 A1* 10/2007 Smith ..... B60T 17/228 303/22.6
2008/0097659 A1* 4/2008 Hawthorne ..... B61L 17/00 701/19
2009/0173840 A1* 7/2009 Brown ..... B61L 15/0027 246/1 R
2010/0032529 A1* 2/2010 Kiss ..... B61L 17/02 707/E17.005
2011/0093144 A1* 4/2011 Goodermuth ..... H04L 12/40169 246/167 R
2012/0166109 A1* 6/2012 Kernwein ..... B61L 15/0027 702/47
2013/0261842 A1* 10/2013 Cooper ..... B61L 25/028 701/1
2013/0344802 A1* 12/2013 Armour ..... H04W 24/00 455/39
2014/0336850 A1* 11/2014 Kim ..... B61L 27/70 701/19
2014/0372498 A1* 12/2014 Mian ..... H04W 4/38 709/201
2014/0376554 A1* 12/2014 Komura ..... B61L 15/0072 370/394
2015/0148984 A1* 5/2015 Padulosi ..... B61L 25/028 701/1
2016/0144875 A1* 5/2016 Kim ..... B61L 25/021 370/328
2016/0272228 A1* 9/2016 LeFebvre ..... H04L 67/12
2016/0318497 A1* 11/2016 Wright ..... B60T 17/228
2016/0325767 A1* 11/2016 LeFebvre ..... B61L 27/40
2017/0021847 A1* 1/2017 LeFebvre ..... B61L 25/025
2017/0137047 A1* 5/2017 Kim ..... B61L 15/0027
2018/0194378 A1* 7/2018 Xu ..... B61L 15/0054
2018/0319414 A1* 11/2018 Lefebvre ..... B61L 25/028
2019/0037023 A1* 1/2019 Mian ..... H04W 4/42
2019/0225248 A1* 7/2019 Lidgett ..... B61D 7/26
2019/0319835 A1* 10/2019 Mansfield ..... H04L 41/0823
2020/0023870 A1* 1/2020 Mansfield ..... G01S 3/043
2020/0079343 A1* 3/2020 Martin ..... B60T 17/221
2020/0353961 A1* 11/2020 Bonnes ..... G01S 19/50
2021/0053548 A1* 2/2021 Michel ..... B61L 15/0081
2021/0276526 A1* 9/2021 Gaughan ..... B60T 17/228
2022/0063690 A1* 3/2022 Hogg ..... B61L 27/40
2023/0035869 A1* 2/2023 Martin ..... B60T 17/228
2023/0254204 A1* 8/2023 Mansfield ..... B61L 25/025 73/510
2023/0271638 A1* 8/2023 Bonnes ..... H04W 52/0274 246/122 R
2023/0278607 A1* 9/2023 Mansfield ..... B61L 25/028 246/122 R
2024/0010181 A1* 1/2024 Michel ..... B60T 17/228
2024/0101171 A1* 3/2024 Liktor ..... H04W 4/42
2024/0351566 A1* 10/2024 Martin ..... B61H 13/00

FOREIGN PATENT DOCUMENTS

DE 202012012558 U1 5/2013
EP 2323886 B1 4/2014
EP 3081445 A1 * 10/2016 ..... B60T 13/66
EP 3326887 A1 5/2018
EP 3619082 B1 12/2020
EP 3778344 A2 2/2021
WO 2015081278 A1 6/2015
WO 2016191711 A1 12/2016
WO 2018176072 A1 10/2018

OTHER PUBLICATIONS

Patent Cooperation Treaty Third Party Observation corresponding to PCT/EP2022/065505 dated May 8, 2023.
Chinese Office Action corresponding to Chinese Patent Application No. 202280036566.2 dated Jan. 30, 2026.

* cited by examiner

DIGITAL FREIGHT CAR—AUTOMATIC WAGON LIST

PRIORITY CLAIM AND CROSS REFERENCE

This patent application is a U.S. National Phase of International Patent Application No. PCT/EP2022/065505 filed Jun. 8, 2022, which claims priority to European Patent Application No. 21179549.7, the disclosure of which being incorporated herein by reference in their entireties.

FIELD

Disclosed embodiments relate to a system and method for automatic generation of a list of units in a train comprising multiple units, or more particularly to a system and method for automatic generation of a wagon list in a freight train comprising multiple wagons. Further, disclosed embodiments relate to a control device for receiving detected parameters from a plurality of sensor means mounted to respective units in the train and for processing the detected parameters for generation of the list of units.

BACKGROUND

In current practice, the generation of a list of units in a train comprising multiple units, for example a freight train comprising multiple wagons, is carried out manually. In particular, according to current practice train assembly personnel walks alongside the train and identifies the positions of the units in the train, that is the positions of the wagons in the freight train, to generate a list of units or to verify an available list of units. Therein, the units in the train are usually labeled with a wagon number, equipped with a paper-based identification sheet or possess any other kind of identifier that can be checked manually by the train assembly personnel. The identified list of units is then used for further processing, for example for consequent brake testing and brake weight calculation, which is performed on a paper base. However, such manual identifications are time intense since the train assembly personnel needs to walk alongside the train and to identify the units in the train sequentially, one by one. Furthermore, such manual identifications are also error-prone since they rely on the skills of the train assembly personnel, which may also cause an additional delay for correcting errors and rearrange trains. Further, such manual identifications can only be carried out when the train is not in operation, for example, when the train is in an operating site such as a marshalling yard or shunting yard, where the train assembly personnel can walk safely alongside the train.

Furthermore, a train composition may be subject to change. For example, one or more units may be added to the train or removed from the train after an operation phase of the train depending on a freight transported in the respective unit. A following operation phase of the train with changed composition of units may then require a repeated generation of a new list of units in the train, for example for brake testing. Flowever, a repeated manual generation of a new list of units is time intense and causes a significant delay before the new list of units can be used for brake testing and the train with new composition of units can be put into operation.

SUMMARY

Disclosed embodiments provide a system and a method for automatic generation of a list of units in a train comprising multiple units. Therein, the system comprises a plurality of sensor means, wherein each of the plurality of sensor means is configured to be mounted to a respective unit of the train and each of the plurality of sensor means is configured to detect a parameter of the respective unit of the train to which it is mounted that is suitable to provide an information about the position of the unit with respect to another unit in the train. Moreover, each of the plurality of sensor means is configured to communicate with one or more of the plurality of sensor means, and the plurality of sensor means forms a sensor mesh network to transmit the detected parameters for processing. Further, the system comprises a control device configured to receive the detected parameters from sensor mesh network and to process the detected parameters for generation of the list of units.

BRIEF DESCRIPTION OF FIGURES

In the following detailed description, presently disclosed embodiments are further described with reference to the following figures in which.

DETAILED DESCRIPTION

Figure 1:
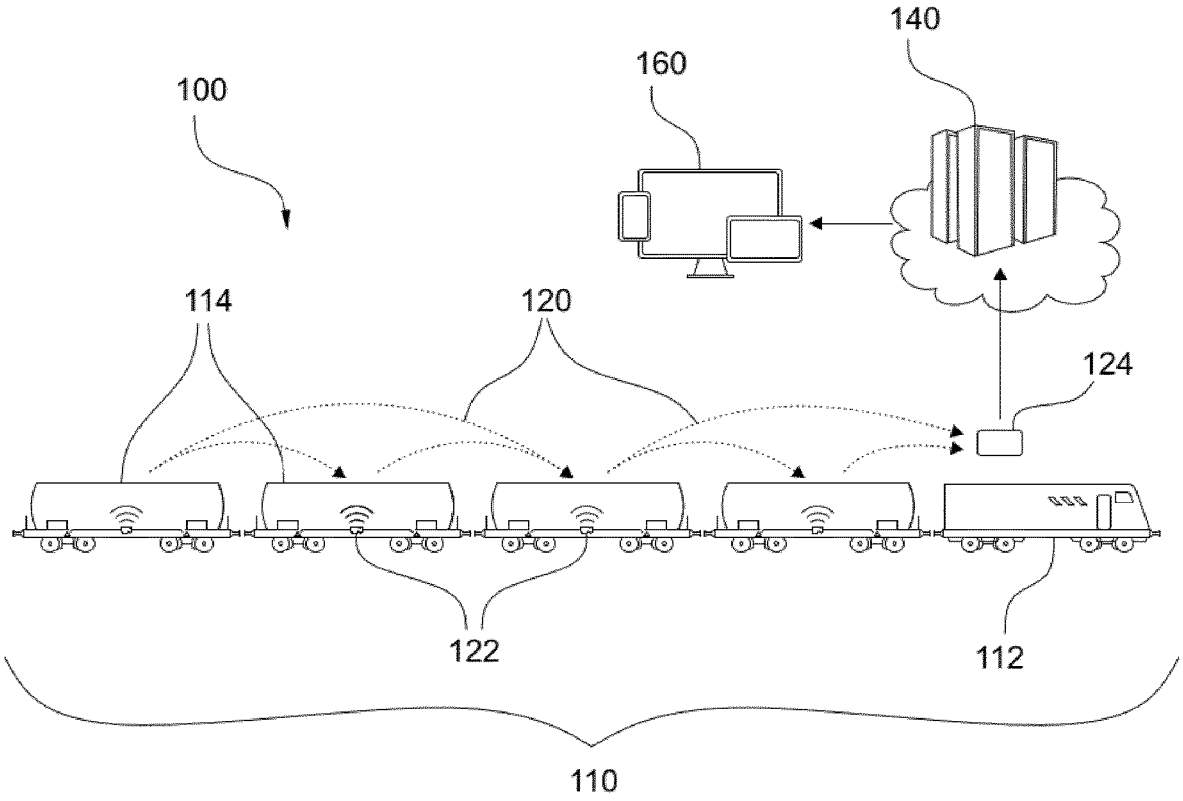
FIG. 1 shows a system overview of a system for automatic generation of a list of units in a train comprising multiple units according to an embodiment.

Current systems detect a sequence of units in a train via GPS for performing brake testing as disclosed in EP3081445B1 or determine a wagon sequence in a train by use of pressure measuring devices in the main air line and time measuring devices synchronized via communication device in the range of a communication device initiating the brake test as disclosed in DE202012012558U1. Furthermore, the continuity of a train for brake testing was detected via pneumatic continuity testers and more specifically via a pneumatic continuity tester on an electrically controlled pneumatic train brake system as disclosed in US2002139181A1.

Flowever, the system of the state of the art have certain shortcomings such as their dependence of the availability of the GPS which can be disturbed if a train is in a tunnel.

It is, therefore, the technical problem underlying the presently disclosed embodiments to provide an improved system and a method for an efficient and fail-safe automatic generation of a list of units in a train that overcomes the shortcomings of conventional systems.

The technical problem is solved by a system and a method for automatic generation of a list of units in a train as disclosed.

In general, the presently disclosed embodiments provide a system for automatic generation of a list of units in a train comprising multiple units. Therein, the system comprises a plurality of sensor means, wherein each of the plurality of sensor means is configured to be mounted to a respective unit of the train and each of the plurality of sensor means is configured to detect a parameter of the respective unit of the train to which it is mounted that is suitable to provide an information about the position of the unit with respect to another unit in the train. Moreover, each of the plurality of sensor means is configured to communicate with one or more of the plurality of sensor means, and the plurality of sensor means forms a sensor mesh network to transmit the detected parameters for processing. Further, the system comprises a control device configured to receive the detected parameters from sensor mesh network and to process the detected parameters for generation of the list of units.

It is conceivable, that the sensor mesh network is either a cable-based sensor mesh network or a wireless sensor mesh network. A sensor mesh network is a communication network that is made up of sensor means configured to transmit and receive data, and is organized in a mesh topology. A mesh refers to rich interconnection among the sensor means along the train. Each sensor means acts also as a provider forwarding data to a next sensor means. The networking infrastructure is decentralized and simplified because each sensor means need only transmits at least as far as the next connected sensor means. The control device may be configured to access the sensor mesh network at any unit in the train. The position of the control device may be published into and propagated through the sensor mesh network such that the position of the control device along the train is determined.

Consequently, the system can automatically generate a list of units in the train in a matter of seconds irrespective of the location, length and composition of the train and irrespective of the position of the control device along the train by the use of the plurality of sensor means mounted to respective units in the train for detecting a parameter of the respective unit of the train and establishing a unit-to-unit communication and forming a sensor mesh network, and by use of a control device for receiving the collected parameters from the sensor mesh network and for processing the detected parameters for automatic generation of the list of units. In this way the list of units can be generated without the need for manual inspection of the units in the train. More particularly, there is no need for the train assembly personnel to walk alongside the train to manually identify the positions of the units in the train for generation of the list of units. Thus, the generation of the list of units can be performed efficiently and in a matter of seconds. The generated list of units can then, for example, be used for a brake weight calculation and the control device can be used as a brake test controller without significant delay after assembly of the train and prior to operation of the train. In addition, the generation of the list of units in the train is more reliable and less error-prone since the list of units is generated automatically based on detected parameters from a plurality of sensor means and is thus, not dependent on the skills of the train assembly personnel. Furthermore, this is particularly advantageous when a train composition changes after an operation phase of the train and a new list of units has to be generated for the new train composition prior to brake testing and a new operation phase of the train. The new list of units can be generated within seconds According to an embodiment, each of the plurality of sensor means is associated with an identifier of the respective unit in the train to which it is mounted and each of the plurality of sensor means is configured to transmit the detected parameter and the associated identifier of the unit in the train to which it is mounted to the control device or a server for processing and generation of the list of units. It is conceivable that such identifiers may be a series of numbers, a series of letters, or a series of numbers and letters, a bar code or an QR-Code that can be transmitted by the plurality of sensor means as a stream of data bits and received and processed by the control device.

In another embodiment, the system further comprises a database or a server configured to receive the detected parameters and identifiers from the sensor mesh network or configured to receive the detected parameters and identifiers or the generated list of units from the control device. It is conceivable that the server is then configured to process the detected parameters and identifiers for generation of the list of units or is configured to keep record of the detected parameters and identifiers or the generated list of units. Furthermore, in case the list of units is generated by the server, the control device may be configured to receive the generated list of units from the server for brake testing.

In a further embodiment, the control device comprises at least one interface for a manual input of data related to one or more items of the list of units and is configured to generate the list of units based at least in part on the manual input of the data related to the one or more items of the list of units via the interface.

Thus, the control device may feature at least one interface for manual input of data related to one or more items of the list of units, for example an item corresponding to a newly added unit in the train. The interface for manual input of data may be an interface for manual text input, such as a touch pad or a key board, for inputting of text, for example a series of numbers or letters, associated with the one or more units in the train and correspondingly, associated with the one or more items of the list of units. Further, the control device may comprise an RFID reader to read out RFID tags associated with the one or more units in the train to provide the data related to the one or more items of the list of units. The control device may also comprise a QR code reader or any other type of 2D code reader, such as a camera, to read out QR code or any other type of 2D code associated with the one or more units in the train to provide the data related to the one or more items of the list of units. The control device may have at least one of the interfaces described above depending on the type of units and depending on the used identification solution, i.e. type of identifier, present in the units in the train.

By providing the possibility for manual input of data related to the one or more items of the list of units via the at least one interface, the system is also compatible for recording the position of units in the train that are not equipped with a sensor means. In addition, the position of units can be recorded in the system, where the mounted sensor means on the respective units are not detecting or transmitting any parameters due to a device failure of the sensor means. In this way, the list of units can be generated based on both the manual input of the data related to the one or more items of the list of units via the interface and the detected parameters from a plurality of functional sensor means.

Therefore, the availability of the generation of the list of units in the train is ensured and the fail-safety is increased.

In an embodiment, the system further comprises a user device connected to the server. The user device may then comprise a user interface for manual input of data related to the one or more items of the list of units via the interface. The user device may then be configured to send the data related to the one or more items of the list of units to the server for record keeping or generation of the list of units, or for transmitting the data related to the one or more items of the list of units to the control device for further processing, generation of the list of units, and brake testing.

In an embodiment, the control device may be configured to act as the user device.

According to an embodiment, the multiple units of the train are connected in a brake system and at least one unit in the train, for example a locomotive or traction unit, is configured to control the pressure of a fluid in the brake system. Furthermore, each of the plurality of sensor means comprises a pressure sensor and a timestamp generator to detect a pressure of the fluid in the brake system in the respective unit and to generate a corresponding timestamp of when the pressure of the fluid in the brake system in the respective unit exceeds or falls below a predetermined threshold pressure, respectively, from which an information about the position of the respective unit in the train can be derived.

For example, the locomotive may be configured to set the pressure of the fluid in the brake system to a predetermined value and may be configured to ramp up or ramp down the pressure of the fluid in the brake system in case the pressure of the fluid in the brake system differs from the predetermined pressure value after assembly of the train. This causes a pressure wave or fluid wave to propagate through the fluid in the brake system, i.e. starting from the locomotive along the train. Since each of the plurality of sensor nodes is capable to detect a pressure of the fluid in the brake system in the respective unit to which it is mounted and is capable to produce a corresponding timestamp of when the pressure of the fluid in the brake system in the respective unit exceeds or falls below a predetermined threshold pressure, the propagation of the pressure wave through the fluid in the brake system can be tracked. It is conceivable that corresponding to a first sensing procedure the control device may then be configured to receive the detected pressures, timestamps, and identifiers, to calculate the delays in time between the collected timestamps and, using the corresponding identifiers, the delays in time between the units with which the detected pressures and timestamps are associated and thus, to infer the information about the position of each unit in the train with respect to the another unit in the train and the locomotive for generation of the list of units.

Alternatively, the control device may be configured to calculate the distance of the respective units from the locomotive by using the corresponding timestamp and a propagation velocity of the pressure wave in fluid in the brake system, i.e. the speed of sound in the fluid, to generate the list of units. The list of units is then created, for example, by arranging the timestamps in one column of a table according to their increasing or decreasing values and arranging the respective identifiers of the respective units in the train to which the timestamps are assigned in another column according to the sequence of the timestamps. Thus, the column of identifiers of the respective units in the train represents the list of units of the train. As an alternative, the control device may be configured to receive the detected pressures and timestamps for generation of the one column of timestamps of the table as described above. The list of units is then created by assigning identifiers to the sequence of timestamps in another column, for example, assigning identifiers corresponding to the indices of the entries of timestamps in the table. The list of units is then the column of identifiers in the table.

In general, the plurality of sensor means can detect the pressure of fluid in the brake system essentially safe from disturbing influences in the surroundings of the train and thus, a fail-safe generation of the list of units is ensured. More particularly, the plurality of sensor means can detect the pressure of fluid in the brake system for the following generation of the list of units independently on the location of the train, i.e. independent from whether the train is in a tunnel, in an assembly hall or in the outside, and thus, the plurality of sensor means can detect the pressure of fluid in the brake system safely from any non-related interfering signals in the surroundings, for example disturbing non-related wireless transmissions. Moreover, since the pressure wave through the brake system travels at the speed of sound in the fluid, the pressures and corresponding timestamps can be sampled and transmitted by the plurality of sensor means and received and processed by the control device within seconds for a fast and efficient generation of the list of units.

According to another embodiment, the plurality of sensor means and the control device each comprise a wireless communication module to send and receive signals, and each of the plurality of sensor means is configured to detect a signal strength and an identifier of a wireless communication module of at least one neighboring sensor means from which an information about the position of the unit in the train to which the sensor means is mounted can be derived. Moreover, each of the plurality of sensor means is configured to use the wireless communication module to implement a wireless unit-to-unit communication, wherein the plurality of sensor means forms a wireless sensor mesh network to wirelessly transmit the detected parameters, identifiers, pressures, timestamps, and signal strengths.

A wireless sensor mesh network is a communication network made up of radio nodes, in particular sensor means or sensor nodes publishing data, and is organized in a mesh topology, wherein a mesh refers to rich interconnection among the sensor means or sensor nodes. Each sensor node acts also as a provider forwarding data to a next sensor node. The networking infrastructure is decentralized and simplified because each node need only transmits at least as far as the next connected node. Wireless sensor mesh networks often consist of mesh clients, such as sensor nodes comprising sensor nodes and/or sensor hubs, and mesh gateways, such as the control device or gateway or a sensor node acting as gateway. The position of the control device or gateway may be published into and propagated through the wireless sensor mesh network such that the position of the control device along the train is determined.

According to one embodiment corresponding to a second sensing procedure the control device of the system is configured to receive from one or more of the plurality of sensor means one or more detected signal strengths emitted by one or more wireless communication modules of one or more neighboring sensor means and the respective one or more identifiers as well as the corresponding identifiers of the one or more of the plurality of the sensor means by which the one or more signal strengths and the respective one or more identifiers of the neighboring sensor means have been detected and thus, to infer therefrom the position of the units in the train with respect to each other for a generation of a list of units.

The list of units is then created, for example, by arranging the identifier of a first sensor means corresponding to a first unit of the train in a field of a table and arranging the identifier of a first nearest neighboring sensor means according to a first detected signal strength in a neighboring field of the table and arranging the identifier of a second nearest neighboring sensor means according to a second detected signal strength which may be similar to the first detected signal strength, which indicates that the second nearest neighboring sensor means in on the opposite side in the train with respect to the first nearest neighboring sensor means, in a field of the table in the same column or row on the opposite side of the identifier of the first sensor means. Thus the column or row of three identifiers of the respective sensor means mounted on units in the train represents the list of units of the train.

If an identifier of a second sensor means and an identifier of a first nearest neighboring sensor means according to a first detected signal strength and an identifier of a second nearest neighboring sensor means according to a second detected signal strength associated with the second sensor means are received, wherein two of the identifiers correspond to identifiers related to the first sensor means it is clear that the second sensor means is a neighboring sensor means of the first sensor means in the train and the identifier of the identifier of the first or second nearest neighboring sensor means which does not correspond to the identifiers related to the first sensor means can be added in the table to the sequence of the three identifiers related to the first unit of the train.

In another embodiment, each of the plurality of sensor means comprises a global navigation satellite system module to detect a position of the unit to which it is mounted from which information about the position of the unit in the train can be derived.

According to an embodiment corresponding to a third sensing procedure the control device of the system is configured to receive the detected positions of the units, which may be described by geographic coordinates, and identifiers and is configured to infer therefrom the position of the units in the train by comparing their relative positions according to the coordinates. The list of units is then created, for example, by arranging the coordinates in a sequence with increasing or decreasing values in one column of a table and in another column the respective identifiers of the respective sensor means or units in the train to which the coordinates are assigned. Thus the column of identifiers of the respective units in the train represents the list of units of the train.

According to one embodiment the control device of the system is configured to receive one or more of detected pressures and timestamps according to the first sensing procedure, to calculate the delays in time between the collected timestamps and the corresponding identifiers of the units with which the detected pressures and timestamps are associated and thus, to infer the information about the position of each unit in the train with respect to the another unit in the train and the locomotive for generation of the list of units, one or more detected signal strengths emitted by one or more wireless communication modules of one or more neighboring sensor means and the respective one or more identifiers as well as the corresponding identifiers of the one or more of the plurality of the sensor means by which the one or more signal strengths and the respective one or more identifiers of the neighboring sensor means have been detected according to the second sensing and thus, to infer therefrom the position of the units in the train with respect to each other for a generation of a list of units, and detected positions of the units which may be described by geographic coordinates according to the third sensing and, to infer therefrom the position of the units in the train by comparing their relative positions according to the coordinates.

The control device may be configured to start receiving and processing parameters according to one of the first, second, and third sensing procedure described above, and infer a list of units therefrom, and subsequently receive and process parameters according to another one of the first, second, and third sensing procedure described above, and therewith complete the list of units or check its accuracy. If the processing of the parameters according to the two of the first, second, and third sensing procedure result in a complete and unambiguous list, the control device may stop further activity of generating the list of units and output the list.

If the control unit determines that the created list is incomplete or some items are ambiguous or if one of the procedures of processing of parameter fails, one or both of the procedures can be repeated or receiving and processing of parameters according to the third of the first, second, and third sensing procedure described above can be started and used for completing or correcting the list.

According to yet another embodiment, the control device is installed on the locomotive or is a handheld device, i.e. a mobile device.

It is conceivable that the control device may be configured to perform a brake test after generation of the list of units and use the generated list of units for a brake weight calculation, which may be necessary prior to operating the train by use of the locomotive or traction unit.

Thus, the control device may be a special device called brake test controller and may be a user device such as a smart phone, tablet, personal digital assistant, or the like. Further, the user device may be a laptop. Furthermore, the user device may also be a computing device with a display.

According to the present invention, a method for automatic generation of a list of units in a train comprising multiple units is provided. Therein, the method comprises associating each of a plurality of sensor means to a plurality of respective units of the train. The method further comprises detecting, by each of the plurality of sensor means, a parameter of the respective unit the sensor means is associated with that is suitable to provide an information about the position of the respective unit in the train. Further, each of the plurality of sensor means is configured to use the wireless communication module for a unit-to-unit communication and the plurality of sensor means forms a sensor mesh network. The method furthermore comprises transmitting, by each of the plurality of sensor means, the detected parameters to a control device or a server via the sensor mesh network, and receiving the detected parameters from the sensor mesh network at the control device and processing the detected parameters to generate the list of units.

Each of the plurality of sensor means or sensor nodes mounted to respective units in the train is configured to detect parameters of the respective units and to implement a unit-to-unit communication. The plurality of sensor means forms a sensor mesh network to transmit the parameters via the sensor mesh network, and the control device is configured for receiving the collected parameters from the sensor mesh network and for processing the detected parameters for automatic generation of the list of units so that the list of units in the train can be generated automatically in a matter of seconds irrespective of the location of the train, length and composition of the train, and the position of the control device along the train. Furthermore, the list of units can be generated without the need for manual inspection of the units in the train. More particularly, there is no need for the train assembly personnel to walk alongside the train to manually identify the positions of the units in the train. Thus, the generation of the list of units can be performed fast and efficiently. In addition, the method of the present invention for automatic generation of the list of units in the train is more reliable and less error-prone since the list of units is generated automatically based on the detected parameters from a plurality of sensor means and is thus, not dependent on the skills of the train assembly personnel. Moreover, this is particularly advantageous when a train composition changes after an operation phase of the train and a new list of units has to be generated for the new train composition prior to brake testing and a new operation phase of the train. The new list of units can be generated within seconds In its embodiments, the above-described method may comprise additional features as described with regard to the system.

Accordingly, in another embodiment, the method further comprises associating each of the plurality of sensor means with a respective identifier of the respective unit in the train the sensor means is associated with. Furthermore, the method comprises transmitting, by each of the plurality of sensor means, the identifier of the unit in the train to the control device for processing and generation of the list of units.

In another embodiment, the method further comprises receiving the detected parameters and identifiers in a database or server from the sensor mesh network or receiving the detected parameters and identifiers or the generated list of units from the control device. It is conceivable that the method further comprises processing, by the server, the detected parameters and identifiers for generation of the list of units.

Alternatively, the method may comprise record keeping, by the server, of the detected parameters and identifiers or the generated list of units. Furthermore, in case the list of units is generated by the server, the method may further comprise transmitting the generated list of units from the server to the control device for consequent brake testing.

In yet another embodiment of the present invention, the method further comprises manually inputting via at least one interface for manual input of the control device one or more items of the list of units, and generating the list of units at least in part based on the one or more items of the list of units.

In an embodiment, the method further comprises connecting the server to a user device. The method may then comprise manually inputting via at least one interface for manual input of the user device one or more items of the list of units. The method may further comprise sending the one or more items of the list of units to the server for record keeping or generation of the list of units, or for transmitting the one or more items of the list of units to the control device for further processing, generation of the list of units, and brake testing.

In an embodiment, the method may comprise using the control device as the user device.

According to an embodiment, the method comprises connecting the multiple units of the train in a brake system, wherein at least one unit in the train, i.e. a locomotive or traction unit, controls a pressure of a fluid in the brake system, and each of the plurality of sensor means comprises a pressure sensor and a timestamp generator, and detecting the pressure of the fluid in the brake system with one or more pressure sensors of the plurality of sensor means and producing a corresponding timestamp of when the pressure of the fluid in the brake system in the respective unit exceeds or falls below a predetermined threshold pressure for the one or more pressure sensors from which an information about the position of the respective unit in the train can be derived.

It is conceivable that the method may comprise setting, by the locomotive, the pressure of the fluid in the brake system to a predetermined value and thus, ramping up or ramping down the pressure of the fluid in the brake system in case the pressure of the fluid in the brake system differs from the predetermined pressure value after assembly of the train. In that event, a pressure waver or fluid wave propagates through the fluid in the brake system. Since the method further comprises detecting, by each of the plurality of sensor means mounted to a respective unit in the train, a pressure of the fluid in the brake system and producing a corresponding timestamp of when the pressure of the fluid in the brake system in the respective unit exceeds or falls below a predetermined pressure threshold, the propagation of the pressure wave through the fluid in the brake system can be tracked. The method may then comprise calculating, by the control device, delays in time between the detected timestamps and thus, inferring the information about the position of each of the units in the train with respect to the other units in the train and the locomotive to generate of the list of units. Alternatively, the method may comprise calculating, by the control device, the distance of the respective units from the locomotive by using the corresponding timestamps and a propagation velocity of the pressure wave in fluid in the brake system, i.e. the speed of sound in the fluid, to generate the list of units.

Since the detection of the pressures of the fluid in the brake system by use of the plurality of sensor means is essentially safe from disturbing influences in the surroundings, a fail-safe generation of the list of units is ensured. More particularly, the detection of pressures of the fluid in the brake system for the following generation of the list of units is independent from the location of the train, i.e. independent from whether the train is in a tunnel, in an assembly hall or in the outside, and is essentially safe from any non-related interfering signals in the surroundings, for example disturbing non-related wireless transmissions. Moreover, since the pressure wave through the fluid in the brake system travels at the speed of sound in the fluid, the pressures and corresponding timestamps can be sampled and transmitted by the plurality of sensor means and received and processed by the control device within seconds for a fast and efficient generation of the list of units.

According to an embodiment, the method further comprises detecting with one or more of the plurality of sensor means a signal strength of at least one respective neighboring sensor means to provide an information about the position of the respective unit associated with the neighboring sensor means in the train. Therein, each of the plurality of sensor means and the control device comprise a wireless communication module to send and receive signals, and transmit the information about the position of the respective unit associated with the neighboring sensor means in the train. Further, each of the plurality of sensor means uses the wireless communication module to implement a wireless unit-to-unit communication, wherein the plurality of sensor means forms a wireless sensor mesh network to wirelessly transmit the detected parameters, identifiers, pressures, timestamps, and signal strengths.

According to yet another embodiment of the present invention, the method further comprises detecting with one or more of the plurality of sensor means means a position of the respective unit associated with the sensor means. Therein, each of the plurality of sensor means comprises a global navigation satellite system module to detect a position of the unit and transmits the information about the position of the respective unit associated with the sensor means in the train.

According to an embodiment of the present invention, the method comprises generating the list of units and evaluating the accuracy of the list of units based on one or more of the detected parameters, identifiers, timestamps, signal strengths, positions, and manual input of one or more items of the list of units.

Since the generation of the list of units and evaluation of the accuracy of the list of units is performed based on one or more of the detected parameters, identifiers, timestamps, signal strengths, positions, and manual input of data related to one or more items of the list of units, the accuracy, availability, and fail-safety of the generation of the list of units in the train is increased.

For example, in each of the units in the train a "filled" state of the brake system may be recognized by the respective sensor nodes if the pressure in the fluid in the brake system reaches a predetermined pressure value, and the method may further comprise waking the system from a sleep mode if any of the units were in sleep mode.

Subsequently, the method may comprise detecting the positions of the units in the train via the global navigation satellite system modules in the sensor nodes for cross checking. Further, the method may result in determining that the list of units is sufficiently accurate by using only one or two of the automatic detection means of parameters, pressures, timestamps, signal strengths, or positions. In that case, the method may comprise stopping to use the other detection means for energy saving. Further, if the evaluated accuracy is below a predetermined threshold, for example the presence of two contradicting detected parameters or lack of a parameter is recognized by the control device, the detection of signal strengths and positions may automatically be repeated for the generation of a new list of units. Moreover, if the train is in a tunnel and a detection of the positions of the units in the train via the global navigation satellite system modules in the sensor nodes is not available, the method may comprise reverting to any of the remaining means to detect parameters, pressures, signal strengths, identifiers, or manual input of data related to one or more items of the list of units, for providing the information of the units in the train for generation of the list of units. Thus, by generating the list of units based on one or more of the detected parameters, identifiers, timestamps, signal strengths, positions, and manual input of data related to one or more items of the list of units, a reliable and fail-safe generation of the list of units can be ensured.

According to another embodiment, the method further comprises using the control device as a brake test controller for brake testing after generation of the list of units and using the generated list of units for a brake weight calculation.

In the following, disclosed embodiments are described with respect to a system for automatic generation of a list of units in a train comprising multiple units. The approaches disclosed herein generally serve for providing an efficient and fail-safe automatic generation of a list of units in a train.

Figure 2:
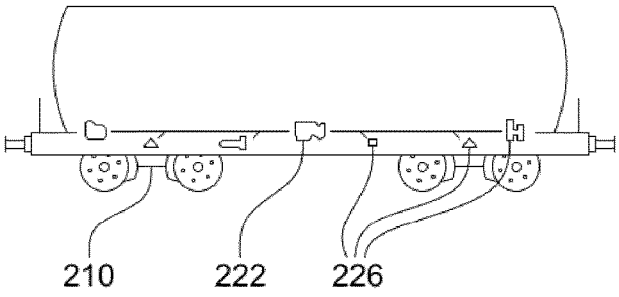
FIG. 2 shows s system overview of a system for automatic generation of a list of units in a train in an individual unit of the train according to an embodiment.

FIGS. 1-2 shows a system overview of a system 100 for automatic generation of a list of units in a train 110 comprising multiple units 114 according to an embodiment. Therein, the system 100 comprises a plurality of sensor means 222, wherein each of the plurality of sensor means 222 is mounted to a respective unit 114 of the train 110 and is configured to detect one or more parameters of the respective unit 114 of the train 110 to which it is mounted that is suitable to provide an information about the position of the unit 114 with respect to another unit 114 in the train 110. Moreover, the system 100 comprises a control device 124 configured to receive the detected parameters from the plurality of sensor means 222 and to process the detected parameters for generation of the list of units.

As partly shown in FIGS. 1 and 2, each of the plurality of sensor means or sensor nodes 222 may comprise several components including a microcontroller, timestamp generator, transceiver, wireless communication module 122, memory, power source, one or more pressure sensors 226, and global navigation satellite system module 226. The microcontroller performs tasks, processes data and controls the functionality of other components in the sensor node 222. A power source in each of the plurality of sensor nodes usually comprises a battery, such as a NiCd (nickel-cadmium), NiZn (nickel-zinc), NiMH (nickel-metal hydride), or lithium-ion battery. Alternatively, the plurality of sensor nodes may make use of an electric powerline in the train if present. The memory in each of the plurality of sensor nodes may be one of on-chip or off-chip memory for storing data including the detected parameters and an identifier, such as a digitized series of numbers or letters or a combination of numbers and letters, which is associated with the respective unit 114 of the train 110 to which the sensor node is mounted. The transceiver makes use of the wireless communication module 122 to transmit and receive data in the form of signals, i.e. data related to the detected parameter and the identifier retrieved from its own memory or other detected parameters and identifiers received from neighboring sensor nodes. Alternatively, the transceiver may make use of cable-based connections between the units 114 in the train 110 if present to transmit and receive signals. The timestamp generator in each of the plurality of sensor nodes is capable of generating timestamps with time intervals between individual timestamps as appropriate. Taking into account the speed of propagation of pressure typical time intervals are in a range equal to or less than 100 ms, 10 ms or 1 ms, with no limitation on these numbers. The one or more pressure sensors as described with reference to FIG. 2 may be affixed to a distributor valve of the brake system 210 in the respective unit 114. Preferably, the distributor valve of the unit 114 is the distributor valve of a compressed air circuit. A pressure sensor 226 has specific characteristics such as accuracy, sensitivity etc. appropriate for detecting pressure changes in the brake system of the train.

As presented in FIGS. 1 and 2, the multiple units 114 of the train 110 are connected in a brake system 210 and at least one unit 114 in the train 110, for example a locomotive 112, is configured to control the pressure of a fluid in the brake system 210. Further, each of the plurality of sensor nodes 222 are configured to detect a pressure of the fluid in the brake system 210 in the respective unit 114 to which it is mounted and to generate a corresponding timestamp of when the pressure of the fluid in the brake system 210 in the respective unit 114 exceeds or falls below a predetermined threshold pressure, respectively, from which an information about the position of the respective unit 114 in the train 110 can be derived. In particular, the locomotive 112 may be configured to set the pressure of the fluid in the brake system 210 to a predetermined value and for example, may ramp up the pressure in the brake system 210 in case the pressure in the brake system 210 is lower than the predetermined pressure value after assembly of the train 110. In that event, a pressure wave or fluid wave propagates through the fluid in the brake system 210. Since each of the plurality of sensor nodes 222 detect a pressure of the fluid in the brake system 210 in the respective unit 114 to which it is mounted via the one or more pressure sensors 226 and produces a corresponding timestamp of when the pressure of the fluid in the brake system 210 in the respective unit 114 exceeds a predetermined threshold pressure via the timestamp generator, the propagation of the pressure wave through the fluid in the brake system 210 can be tracked. An analog signal produced by the one or more pressure sensors 226 in a sensor node 222 may preferably be digitized by an analog-to-digital converter and sent to the microcontroller in the sensor node 222 for further processing or storage in the memory. The control device 124 may then be configured to receive the detected pressures and timestamps from the sensor nodes 222 and to calculate the delays in time between the collected timestamps and thus, is able to infer the information about the position of each of the units 114 in the train 110 with respect to the other units 114 in the train 110 and the locomotive 112 for generation of the list of units. Alternatively, the control device 124 may be configured to calculate the distance of the respective units 114 from the locomotive 112 by using the corresponding timestamps and a propagation velocity of the pressure wave in fluid in the brake system 210, i.e. the speed of sound in the fluid, to generate the list of units.

The wireless communication module 122 in each of the plurality of sensor nodes 222 may comprise an antenna to send and receive signals, which includes but is not limited to antennas for Wireless Local Area Network (WLAN), Bluetooth or other radio frequency (RF) signals. Each of the plurality of sensor nodes 222 can thus communicate with at least one neighboring sensor node 222 within a range of their antenna, for example within the range of tens or hundreds of meters. Consequently, each of the plurality of sensor nodes 222 is capable of determining a signal strength of at least one neighboring sensor node 222 to provide an information about the position of the respective unit 144 with regard to the neighboring unit 144 in the train 110 for generation of the list of units. Furthermore, each of the plurality of sensor nodes 222 comprises a global navigation satellite system module 226 as described above and detects a position of the unit 114 to which it is mounted from which information about the position of the unit 114 in the train 110 can be derived for generation of the list of units.

Accordingly, the plurality of sensor nodes 222 are configured to implement a wireless unit-to-unit communication via the wireless communication modules 122, to determine a mesh topology by detecting, with each of the plurality of sensor nodes the one or more sensor nodes 222 in other units 114 they are connected with, via the wireless unit-to-unit communication, and to form a wireless sensor network 120 as presented in FIG. 1. The wireless sensor network 120 may then be configured to propagate the detected parameters, pressures, timestamps, signal strengths, positions, and identifiers through the wireless sensor network 120 to the control device 124, i.e. sequentially receive and transmit the detected parameters, pressures, timestamps, signal strengths, positions, and identifiers from one sensor node 222 to a neighboring sensor node 222 to the control device 124 as presented in FIG. 1.

As described above, the system 100 comprises a control device 124 or a gateway configured to receive and process the detected parameters, pressures, timestamps, signal strengths, positions, and identifiers from the sensor network 120 for generation of the list of units. The control device 124 may be installed on the locomotive 112 or may be a handheld device, i.e. a mobile device, comprising a wireless communication module 122 as described above. Accordingly, the control device 124 may be a user device such as a smart phone, tablet, personal digital assistant, or the like. Further, the user device may be a laptop or a desktop computer. Furthermore, the user device may also be a computing device with a display.

Moreover, the control device 124 comprises at least one interface for manual input of data related to one or more items of the list of units, for example an item corresponding to a newly added unit 114 in the train 110. The interface for manual input of data may be an interface for manual text input, such as a touch pad or a key board, for inputting of text or an identifier, for example a series of numbers or letters, associated with the one or more units in the train and correspondingly, associated with the one or more items of the list of units. Further, the control device 124 may comprise an RFID reader to read out RFID tags associated with the one or more units 114 in the train 110 to provide the data related to the one or more items of the list of units. The control device 124 may also comprise a QR code reader or any other type of 2D code reader, such as a camera, to read out QR code or any other type of 2D code associated with the one or more units in the train to provide the data related to the one or more items of the list of units.

In case the control device 124 is a handheld device, i.e. a mobile device, as described above, it may further comprise a camera and a processing module embodied by an integrated hardware and software solution for recognition of 2D code or text to recognize identifiers painted on the side of respective units 114 in the train 110, for example a series of numbers or letters, QR code or any other type of visual 2D code identifying the respective units 114 in the train 110 on which they are painted. Further, the control device 124 may comprise an RFID reader to read out RFID tags mounted to the respective units 114 in the train 110, to provide data related to the one or more items of the list of units. In this way, manual input of data related to one or more items on the list of units can be provided as described above.

The generation of the list of units and the evaluation of the accuracy of the list of units based on one or more of the detected parameters, identifiers, timestamps, signal strengths, positions, and manual input of data related to one or more items of the list of units, may be embodied by a specific application running on the control device 124 performed by an integrated software and hardware solution.

The system 100 may further comprise a database or server 140 that is configured to receive the detected parameters or the generated list of units from the control device 124 for processing or record keeping. Therein, the control device 124 and server 140 may use any transfer protocol to transfer data related to the generated list of units, such as the Flypertext Transfer Protocol. On the other hand, the control device 124 may receive data related to one or more items on the list of units from the server 140 for generation of the list of units.

The server 140 may be communicatively coupled to a user device 160 or alternatively may be communicatively coupled to the control device 124 acting as user device 160. The user device 160 may be a user device as described above, that is a mobile device, such as a smart phone, tablet, personal digital assistant, or the like. Furthermore, the user device 160 may also be a computer, such as a laptop or a desktop computer. Furthermore, the user device 160 may be a computing device with a display device which is removable affixed to the computing device.

Furthermore, the user device 160 may be configured to perform a component test, and in particular a brake test and brake weight calculation by use of the generated list of units. The brake test and brake weight calculation may be embodied by a specific application running on the user device 160 or control device 124 acting as user device. Thus, the user device 160 or control device 124 acting as user device may be a special device called brake test controller. Such brake test controller may be an integrated hardware and software solution which together perform the application embodying the brake test and the brake weight calculation based on the generated list of units.

As described above, the sensor nodes 222 can forward the detected parameters pressures, timestamps, signal strengths, positions, and identifiers through the wireless sensor network 120 to the control device 124 for processing and generation of the list of units. On the other hand, the position of the control device 124 may also be propagated through the wireless sensor network 120 along the train 110, for example for automatically determining the position of the locomotive 112 in the train 110 in case the control device 124 is located on the locomotive 112 and the locomotive 112 does not comprise a dedicated sensor node 222. Thus, the information about the position of the locomotive 112 in the train 110 can be provided to the control device 124 or the server 140 for example, for consequent brake testing.

Moreover, if the control device 124 is a portable device, i.e. handheld device, with a wireless communication module 122, the control device 124 can be used as a signal strength detector. Thus, while walking with the control device 124 from one end of the train 110 to the other end of the train 110, for example while walking from the locomotive 112 as one end of the train 110 to the other end of the train 110 or vice versa or both, the control device 124 can generate the list of units in the train by detecting the signal strengths and corresponding identifiers of the units 144 in the train 110. The control device 124 can then generate the list of units based on the detected signals strengths and identifiers. It is conceivable that the control device 124 can then generate a first list of units in the train, for example, by walking from the locomotive 112 as one end of the train 110 to the other end of the train 110, and a second list of units in the train by walking back. Both lists of units can then be used for cross-checking and evaluating the accuracy of the list of units.

Consequently, the system 100 is capable of generating the list of units and evaluating the accuracy of the list of units based on one or more of the detected parameters, identifiers, timestamps, signal strengths, positions, and manual input of data related to one or more items of the list of units.

It is conceivable that in each unit 114 in the train 110 a "filled" state of the brake system 210 may be recognized by the respective sensor nodes 222 if the pressure in the fluid in the brake system 210 reaches a predetermined pressure value, and the system 100 is to wake itself from a sleep mode if any of the units 114 were in sleep mode.

Subsequently, the positions of the units 114 in the train 110 may be acquired via the global navigation satellite system modules 226 in the sensor nodes 222.

Further, the system 110 may determine that the list of units is sufficiently accurate by using only one or two of the automatic detection of pressures, timestamps, signal strengths, or positions. In that case, the system 100 may be configured to stop using the other detection means for saving energy. Further, if the evaluated accuracy is below a certain threshold, for example the presence of two contradicting detected parameters or the lack of a parameter is recognized by the control device, the detection of signal strengths and positions may automatically be repeated for the generation of a new list of units. Additionally, if the train 110 is in a tunnel and a detection of the positions of the units 114 in the train 110 via the global navigation satellite system modules 226 in the sensor nodes 222 is not available, the system 100 is capable of reverting to any of the remaining means to detect parameters, pressures, signal strengths, identifiers, or manual input of data related to one or more items of the list of units, for providing the information of the units 114 in the train 110 to generate the list of units. Thus, by generating the list of units based on one or more of the detected parameters, identifiers, timestamps, signal strengths, positions, and manual input of data related to one or more items of the list of units, a fail-safe and reliable generation of the list of units is ensured.

Furthermore, once the list of units is generated, it may be checked again for accuracy or if the train 110 was assembled correctly by the assembly personnel. The generated list of units may then be signed and sent to the server 140 for record keeping or further processing, but mainly is further used for a brake weight calculation and brake testing on the brake test controller 124 or user device 160.

Various modifications can be done to the embodiments without leaving the scope of the disclosure. For example, each of the plurality of sensor means 222 may comprise a voltage sensor 226 to measure a voltage drop in an electrical power line along the train 110, in case the units 1114 in the train 110 are connected in a power line, to provide an information about the position of the respective unit 114 in the train 110.

Moreover, it is noted that the train 110 may comprise more than five or less than five units 114, as well as more than one locomotive in contrast to as it is shown in FIG. 1.

LIST OF REFERENCE SIGNS

100 system
110 train comprising multiple units
120 wireless sensor network
114 unit in the train
112 locomotive
122 wireless communication module
124 control device, brake test controller
140 server
160 user device
210 brake system
222 sensor means, sensor node
226 pressure sensor, global navigation satellite system module

The invention claimed is:

1. A system for automatic generation of a list of units in a train comprising multiple units, the system comprising:

a plurality of sensor means, wherein each of the plurality of sensor means is configured to be mounted to a respective unit of the multiple units of the train and each of the plurality of sensor means is configured to detect a parameter and a pressure, of the respective unit of the train to which it is mounted and configured to provide an information about a position of the respective unit with respect to another unit of the multiple units in the train, and wherein each of the plurality of sensor means is configured to communicate with one or more of the plurality of sensor means, and the plurality of sensor means forms a sensor mesh network to transmit the detected parameters for processing; and a control device configured to receive the detected parameters from the sensor mesh network, to process the detected parameters, and to generate the list of units, wherein each of the plurality of sensor means and the control device comprises a wireless communication module to send and receive signals, and each of the plurality of sensor means is configured to detect a signal strength and identifier of the at least one neighboring sensor means from which the information about the position of the unit in the train to which the sensor means is mounted is derived, wherein each of the plurality of sensor means is configured to use the wireless communication module for a wireless unit-to-unit communication, and wherein the wireless communication modules of the plurality of sensor means wirelessly transmit each of the detected parameters, identifiers, pressures, and signal strengths, wherein the control device is configured to generate the list of units based on each of the identifiers and any of the detected parameters, pressures, and signal strengths in response to unavailability of a global navigation satellite system module.

2. The system of claim 1, wherein each of the identifiers of plurality of sensor means is associated with the respective unit in the train to which it is mounted and each of the plurality of sensor means is configured to transmit the detected parameter and the associated identifier of the respective unit in the train to which it is mounted to the control device or a server for processing and generation of the list of units.

3. The system of claim 1, wherein the control device comprises at least one interface for a manual input of data related to one or more items of the list of units and is configured to generate the list of units based at least in part on the manual input of the data related to the one or more items of the list of units via the at least one interface.

4. The system of claim 1, wherein the multiple units of the train are connected in a brake system, the pressure is a pressure of a fluid in the brake system, at least one unit in the train is configured to control the pressure of the fluid in the brake, system, and each of the plurality of sensors means comprises a pressure sensor and a timestamp generator to detect the pressure of the fluid in the brake system and to generate a corresponding timestamp of when a change in the pressure of the fluid in the brake system in the respective unit exceeds or falls below a predetermined threshold pressure, respectively, from which the information about the position of the respective unit in the train is derived.

5. The system of claim 1, wherein each of the plurality of sensor means comprises a global navigation satellite system module to detect the position of the unit to which it is mounted from which the information about the position of the unit in the train is derived.

6. The system of claim 1, wherein the control device is a fixed or a handheld device.

7. A train comprising: the system of claim 1.

8. A method for automatic generation of a list of units in a train comprising multiple units, the method comprising:

associating each of a plurality of sensor means to a respective unit of the train each of the plurality of sensor means being configured to communicate with one or more of the plurality of sensor means, and the plurality of sensor means forming a sensor mesh network;

each of the plurality of sensor means detecting a parameter and a pressure of the respective unit, to provide an information about a position of the respective unit in the train each of the plurality of sensor means transmitting the detected parameters via the sensor mesh network to a control device or a server; and receiving the detected parameters from the sensor mesh network at the control device and processing the detected parameters to generate the list of units;

associating each of the plurality of sensor means with an identifier of the unit in the train the sensor means is associated with and each of the plurality of sensor means transmitting the identifier of the unit in the train to the control device for processing and generation of the list of units;

detecting, with one or more of the plurality of sensor means, a signal strength of at least one neighboring sensor means to provide the information about the position of the unit associated with the neighboring sensor means in the train, wherein each of the plurality of sensor means and the control device comprise a wireless communication module to send and receive signals, and transmit the information about the position of the unit associated with the neighboring sensor means in the train, and wherein each of the plurality of sensor means uses the wireless communication module for a wireless unit-to-unit communication, and wherein the plurality of sensor means forms a wireless sensor mesh network;

wirelessly transmitting each of the detected parameters, identifiers, pressures, and signal strengths, strengths; and generating the list of units based on each identifier of the identifiers and any of the detected parameters pressures, and signal strengths in response to unavailability of a global navigation satellite system module.

9. The method of claim 8, further comprising manually inputting, via at least one interface for manual input of the control device, one or more items of the list of units, and generating the list of units at least in part based on the one or more items of the list of units.

10. The method of claim 8, further comprising connecting the multiple units of the train in a brake system, wherein the pressure is a pressure of a fluid in the brake system, and at least one unit in the train controls the pressure of the fluid in the brake system fluid pressure, system, and each of the plurality of sensors means comprises a timestamp generator, and detecting the pressure of the fluid in the brake system with one or more pressure sensors of the plurality of sensor means and producing a corresponding timestamp of when the pressure of the fluid in the brake system in the respective unit exceeds or falls below a predetermined threshold pressure for the one or more pressure sensors from which the information about the position of the respective unit in the train is derived.

11. The method of claim 8, wherein each of the plurality of sensor means comprises a global navigation satellite system module to detect the position of the respective unit and transmits the information about the position of the respective unit associated with the sensor means in the train.

12. The method of claim 8, wherein the generating the list of units further comprises evaluating the accuracy of the list of units based on manual input of data related to one or more items of the list of units.

13. The method of claim 8, wherein the method further comprises using the control device as a brake test controller for brake testing after generation of the list of units and using the generated list of units for a brake weight calculation.

* * * * *